US006739395B2

(12) United States Patent
Reynolds

(10) Patent No.: US 6,739,395 B2
(45) **Date of Patent: *May 25, 2004**

(54) TENSIONER/SLIP-JOINT ASSEMBLY

(75) Inventor: Graeme E. Reynolds, Houston, TX (US)

(73) Assignee: Control Flow Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/342,996

(22) Filed: Jan. 15, 2003

(65) Prior Publication Data

US 2003/0102134 A1 Jun. 5, 2003

Related U.S. Application Data

(63) Continuation of application No. 09/881,139, filed on Jun. 14, 2001, now Pat. No. 6,530,430.

(60) Provisional application No. 60/211,652, filed on Jun. 15, 2000.

(51) Int. Cl.[7] ..... E21B 29/12; E21B 12/01

(52) U.S. Cl. ..... 166/346; 166/355; 166/367

(58) Field of Search ..... 166/350, 359, 166/367, 355, 346; 405/224.4, 224.2

(56) References Cited

U.S. PATENT DOCUMENTS 3,280,908 A * 10/1966 Todd ..... 166/340
3,313,345 A * 4/1967 Fisher ..... 166/355
3,646,996 A * 3/1972 Pearce, Jr. ..... 166/212
3,848,668 A * 11/1974 Sizer et al. ..... 166/72
3,871,456 A * 3/1975 Sizer et al. ..... 166/298
3,917,006 A * 11/1975 Kellner ..... 175/5
3,955,621 A * 5/1976 Webb ..... 166/355
4,120,362 A * 10/1978 Chateau et al. ..... 166/339
4,142,584 A * 3/1979 Brewer et al. ..... 166/359
4,215,950 A * 8/1980 Stevenson ..... 405/168.4
4,317,586 A * 3/1982 Campbell ..... 285/95
4,367,981 A * 1/1983 Shapiro ..... 405/224.2
4,379,657 A * 4/1983 Widiner et al. ..... 405/224.4
4,712,620 A * 12/1987 Lim et al. ..... 166/355
4,787,778 A * 11/1988 Myers et al. ..... 405/224.4
4,808,035 A * 2/1989 Stanton et al. ..... 405/224.4
4,883,387 A * 11/1989 Myers et al. ..... 405/224.4
6,419,277 B1 * 7/2002 Reynolds ..... 285/123.1

* cited by examiner

*Primary Examiner*—Robert E. Pezzuto
*Assistant Examiner*—Thomas A Beach
(74) *Attorney, Agent, or Firm*—Anthony F. Matheny; Andrews Kurth LLP

(57) ABSTRACT

The invention is directed to a tensioner/slip-joint module for providing a conduit from a floating vessel at the surface of the ocean to the blowout preventer stack, or production tree, which is connected to the wellhead at the sea floor. The tensioner/slip-joint module compensates for vessel motion induced by wave action and heave and maintains a variable tension to the riser string alleviating the potential for compression and thus buckling or failure of the riser string. The tensioner/slip-joint module of the present invention preferably includes at least one mandrel having at least one hang-off donut; at least one upper flexjoint swivel assembly, at least one radially ported manifold, at least one tensioning cylinder, and at least one slip-joint assembly combined in a single unit.

24 Claims, 5 Drawing Sheets

TENSIONER/SLIP-JOINT ASSEMBLY

RELATED APPLICATION

This application is a continuation of, and claims the benefit of, U.S. application Ser. No. 09/881,139, filed Jun. 14, 2001, now U.S. Pat. No. 6,530,430, which claims the benefit of U.S. Provisional Patent Application Serial No. 60/211,652, filed Jun. 15, 2000.

BACKGROUND OF THE INVENTION

1. Field of the Invention

The invention relates to offshore drilling and production operations and is specifically directed to marine drilling workover/intervention, and production riser slip-joint and tensioning devices and methodologies.

2. Description of Related Art

A marine riser system is employed to provide a conduit from a floating vessel at the water surface to the blowout preventer stack or, production tree, which is connected to the wellhead at the sea floor. A slip-joint is incorporated into the riser string to compensate for vessel motion induced by wave action and heave. A tensioning system is utilized to maintain a variable tension to the riser string alleviating the potential for compression and in turn buckling or failure.

Historically, conventional riser tensioner systems have consisted of both single and dual cylinder assemblies with a fixed cable sheave at one end of the cylinder and a movable cable sheave attached to the rod end of the cylinder. The assembly is then mounted in a position on the vessel to allow convenient routing of wire rope which is connected to a point at the fixed end and strung over the movable sheaves. In turn, the wire rope is routed via additional sheaves and connected to the slip-joint assembly via a support ring consisting of pad eyes which accept the end termination of the wire rope assembly. A hydro/pneumatic system consisting of high pressure air over hydraulic fluid applied to the cylinder forces the rod and in turn the rod end sheave to stroke out thereby tensioning the wire rope and in turn the riser.

The number of tensioner units employed is based on the tension necessary to maintain support of the riser and a percentage of overpull which is dictated by met-ocean conditions i.e., current and operational parameters including variable mud weight, etc.

Normal operation of these conventional type tensioning systems have required high maintenance due to the constant motion producing wear and degradation of the wire rope members. Replacing the active working sections of the wire rope by slipping and cutting raises safety concerns for personnel and has not proven cost effective. In addition, available space for installation and, the structure necessary to support the units including weight and loads imposed, particularly in deep water applications where the tension necessary requires additional tensioners poses difficult problems for system configurations for both new vessel designs and upgrading existing vessel designs.

Recent deepwater development commitments have created a need for new generation drilling vessels and production facilities requiring a plethora of new technologies and systems to operate effectively in deep water and alien/harsh environments. These new technologies include riser tensioner development where direct acting cylinders are utilized.

Current systems as manufactured by Hydralift employ individual cylinders arranged to connect one end to the underside of the vessel sub-structure and one end to the slip-joint outer barrel. These direct acting cylinders are equipped with ball joint assemblies in both the rod end and cylinder end to compensate for riser angle and vessel offset. Although this arrangement is an improvement over conventional wire rope systems, there are both operational and configuration problems associated with the application and vessel interface. For example, one problem is the occurrence of rod and seal failure due to the bending induced by unequal and non-linear loading caused by vessel roll and pitch. Additionally, these systems cannot slide off of the wellbore centerline to allow access to the well. For example, the crew on the oil drilling vessel is not able to access equipment on the seabed floor without having to remove and breakdown the riser string.

The integration of the slip-joint and tensioner system is an improvement over existing conventional and direct acting tensioning systems. Beyond the normal operational application to provide a means to apply variable tension to the marine riser, the system provides a number of enhancements and options including vessel configuration and its operational criteria.

The integrated slip-joint and tensioner system has a direct and positive impact on vessel application and operating parameters by extending the depth of the water in which the system may be used and operational capability. In particular, the system is adaptable to existing medium class vessels considered for upgrade by reducing the structure, space, top side weight and complexity in wire rope routing and maintenance, while at the same time increasing the number of operations which can be performed by a given vessel equipped with the integrated slip-joint and tensioner system.

Additionally, the present invention extends operational capabilities to deeper waters than conventional tensioners by permitting increased tension while reducing the size and height of the oil drilling vessel structure, reducing the amount of deck space required for the slip-joint and tensioner system, reducing the top-side weight, and increasing the oil drilling vessel's stability by lowering its center of gravity.

Moreover, the tensioner/slip-joint module of the present invention is co-linearly symmetrical with tensioning cylinders and the slip-joint parallel to each other. Therefore, the present tensioner/slip-joint module eliminates offset and the resulting unequal loading that causes rapid rod and seal failure in some previous systems.

The tensioner/slip-joint module of the present invention is radially arranged and may be affixed to the oil drilling vessel at a single point. Therefore, the tensioner/slip-joint module maybe conveniently installed or removed as a single unit through a rotary table opening, or disconnected and moved horizontally while still under the oil drilling vessel.

The tensioner/slip-joint module of the present invention further offers operational advantages over conventional methodologies by providing options in riser management and current well construction techniques. Applications of the basic module design are not limited to drilling risers and floating drilling vessels. The system further provides cost and operational effective solutions in well servicing/workover, intervention and production riser applications. These applications include all floating production facilities including, tension leg platform (T.L.P.) floating production facility (F.P.F.) and production spar variants. The system when installed provides an effective solution to tensioning requirements and operating parameters including improving safety by eliminating the need for personnel to slip and cut tensioner wires with the riser suspended in the vessel moon pool. An integral control and data acquisition system provides operating parameters to a central processor system which provides supervisory control.

SUMMARY OF INVENTION

The foregoing advantages have been obtained through the present tensioner/slip-joint module comprising: at least one mandrel; at least one upper flexjoint swivel assembly in communication with the at least one mandrel; at least one manifold in communication with the at least one upper flexjoint swivel assembly, the at least one manifold having a first radial fluid band and a second radial fluid band; at least one slip-joint assembly having an inner barrel slidably engaged within an outer barrel, the inner barrel having an inner barrel housing in communication with the at least one manifold; at least one tensioning cylinder having a blind end, a rod end, and at least one transfer tubing, the blind end being in communication with the first radial fluid band, the at least one transfer tubing being in communication with the second radial fluid band and the rod end being in communication with at least one flexjoint bearing; and a base in communication with the at least one flexjoint bearing.

An additional feature of the tensioner/slip-joint module is that tensioner/slip-joint module may further include at least one lower flexjoint swivel assembly in communication with the outer barrel and the base. A further feature of the tensioner/slip-joint module is that the manifold may include a third radial fluid band, the third radial fluid band being in communication with either the blind end or the at least one transfer tubing. Another feature of the tensioner/slip-joint module is that the first and third radial fluid bands may be in communication with the at least one transfer tubing and the second radial fluid band may be in communication with the blind end of the at least one tensioning cylinder. An additional feature of the tensioner/slip-joint module is that the tensioner/slip-joint module may include six tensioning cylinders, wherein at least one tensioning cylinder may be in communication with a first control source and at least one tensioning cylinder may be in communication with a second control source. Still another feature of the tensioner/slip joint module is that the first control source and second control source may be in communication with the same tensioning cylinder. A further feature of the tensioner/slip-joint module is that the tensioner/slip-joint module may include a hang off donut. Another feature of the tensioner/slip-joint module is that the hang off donut may be disposed on the mandrel or along the tensioning cylinders, e.g., below the blind end of the tensioning cylinders which captures each of the tensioning cylinders and allows for the transference of axial tension load from the cylinder casing to the mandrel and then directly to the rig structure. An additional feature of the tensioner/slip-joint module is that the blind end may be connected to the manifold by at least one sub seal. Still another feature of the tensioner/slip-joint module is that each of the at least one tensioning cylinder may include at least one cylinder head. Yet another feature of the tensioner/slip-joint module is that the first, second, and third radial fluid bands may each be in communication with a transducer. A further feature of the tensioner/slip-joint module is that the tensioner/slip joint module may include at least two tensioning cylinders. Another feature of the tensioner/slip-joint module is that the tensioner/slip-joint module may include two radial fluid bands in communication with at least one transfer tubing and one radial fluid band in communication with the blind end of each of the at least one tensioning cylinder. An additional feature of the tensioner/slip-joint module is that a sub-manifold may be included between the blind end of the tensioning cylinder and the manifold, thereby permitting remotely operated valves to be disposed in the communication channels between the tensioning cylinders and the manifold making it possible to isolate any single or combination of tensioning cylinders for operation, maintenance and Riser Disconnect Management Systems (RDMS) procedures. Still another feature of the tensioner/slip-joint module is that a swivel feature maybe incorporated either within or in the area of the manifold or upper flexjoint swivel assembly, thereby providing a means to remotely turn the entire tensioner/slip-joint module to remove torsional stresses in the riser string that result from the vessel changing heading. A further feature of the tensioner/slip-joint module is that the slip-joint assembly may be inverted with the inner barrel located below the outer barrel.

The foregoing advantages have also been achieved through the present tensioner/slip-joint comprising: at least one mandrel having a first mandrel end and a second mandrel end; at least one upper flexjoint swivel assembly having a first upper flexjoint swivel assembly end and a second upper flexjoint swivel assembly end; at least one manifold having a first manifold surface and a second manifold surface; at least one slip-joint assembly having a first slip-joint assembly end and a second slip-joint assembly end; at least one tensioning cylinder having a blind end, a rod end, and at least one flexjoint bearing in communication with the rod end; and a base, wherein the second mandrel end is connected to the first upper flexjoint swivel assembly end, the second upper flexjoint swivel assembly end is connected to the first manifold surface, the second manifold surface is connected to the first slip-joint assembly end and the blind end, the second slip-joint assembly end and the at least one flexjoint bearing are connected to the base.

An additional feature of the tensioner/slip-joint module is that the tensioner/slip-joint module may further include at least one lower flexjoint swivel assembly having a first lower flexjoint swivel assembly end and a second lower flexjoint swivel assembly end, wherein the second slip-joint assembly end is connected to the first lower flexjoint swivel assembly end, and the at least one flexjoint bearing and the second lower flexjoint swivel assembly end are connected to the base. A further feature of the tensioner/slip-joint module is that the at least one tensioning cylinder may include at least one transfer tubing, the at least one transfer tubing being in communication with the manifold. Another feature of the tensioner/slip-joint module is that the manifold may include two radial fluid bands in communication with the at least one transfer tubing and one radial fluid band in communication with the blind end of the at least one tensioning cylinder. An additional feature of the tensioner/slip-joint module is that the tensioner/slip-joint module may include six tensioning cylinders, wherein at least one of the tensioning cylinders is in communication with a first control source and at least one tensioning cylinder is in communication with a second control source. Still another feature of the tensioner/slip-joint module is that the first control source and the second control source may be in communication with the same tensioning cylinder. A further feature of the tensioner/slip-joint module is that the tensioner/slip-joint module may include a hang off donut. Another feature of the tensioner/slip-joint module is that the slip-joint assembly may include an inner barrel slidably engaged within an outer barrel. An additional feature of the tensioner/slip-joint module is that the at least one manifold may include at least two radial fluid bands.

The foregoing advantages have also been achieved through the present tensioner/slip-joint module comprising: at least one mandrel, at least one upper flexjoint swivel assembly, at least one manifold, at least one slip-joint assembly, and at least one tensioning cylinder, wherein the at least one mandrel, the at least one upper flexjoint swivel assembly, the at least one manifold, the at least one slip-joint assembly, and the at least one tensioning cylinder are integral forming a unitary, co-linear tensioner/slip-joint module.

A further feature of the tensioner/slip-joint module is that the tensioner/slip-joint assembly further includes at least one lower flexjoint swivel assembly. An additional feature of the tensioner/slip-joint assembly is that the at least one mandrel may be connected to the at least one upper flexjoint swivel assembly, the at least one upper flexjoint swivel assembly may be connected to the at least one manifold, the at least one manifold may be connected to the at least one slip-joint assembly and the at least one tensioning cylinder, and the at least one slip-joint assembly and the at least one tensioning cylinder may be connected to the at least one lower flexjoint swivel assembly.

The foregoing advantages have also been achieved through the present method of compensating for offset of an oil drilling vessel connected to a riser or blowout preventer stack comprising the steps of: providing a tensioner/slip-joint module, the tensioner/slip-joint module having at least one mandrel, at least one upper flexjoint swivel assembly, at least one manifold, at least one slip-joint assembly, and at least one tensioning cylinder, wherein the at least one mandrel, the at least one upper flexjoint swivel assembly, the at least one manifold, the at least one slip-joint assembly, and the at least one tensioning cylinder are assembled to form a unitary, co-linear tensioner/slip-joint module; placing the tensioner/slip-joint module in communication with the oil drilling vessel and the riser or blowout preventer stack; and placing the manifold in communication with at least one control source.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DESCRIPTION OF SPECIFIC EMBODIMENTS

The invention comprises elements that when assembled form a unitary, integral, co-linear tensioner/slip-joint assembly, or module. The tensioner/slip-joint module of the present invention may be used to replace both conventional and direct acting tensioning systems. Further, variations of the tensioner/slip-joint module may be utilized in both drilling and production riser applications.

Continuous monitoring and system management provides control of the large instantaneous loads and riser recoil/up-stroke in the event of an unplanned or emergency disconnect. Further, the system is designed to operate at a 100% level with two tension cylinders isolated which is normal practice in tensioning system operations.

Figure 1:
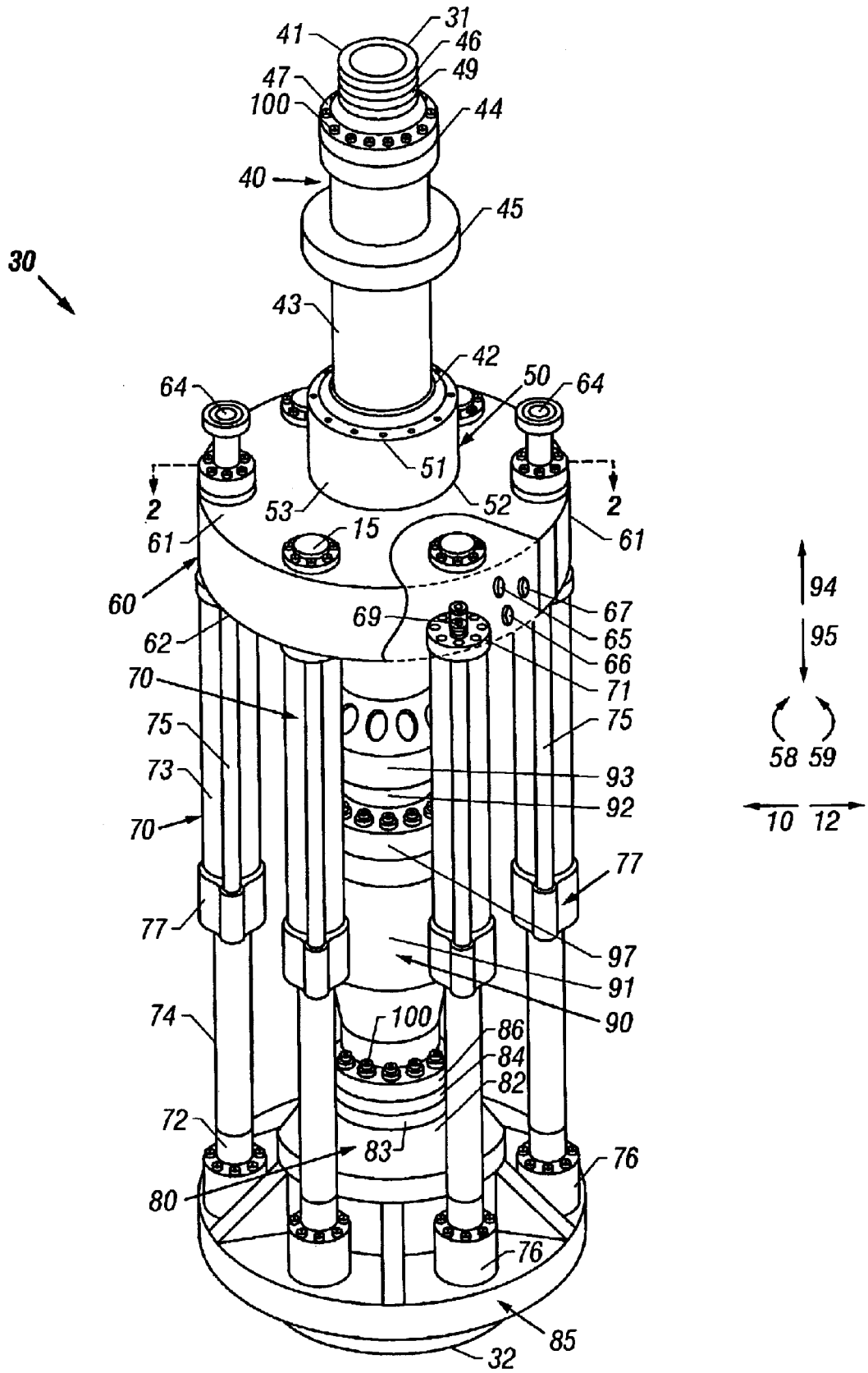
FIG. 1 is a perspective view of one specific embodiment of the tensioner/slip-joint module of the present invention.

Referring now to FIG. 1, broadly, the present invention is directed to a tensioner/slip-joint module 30 having a first tensioner/slip-joint module end 31 and a second tensioner/slip-joint module end 32. Preferably, tensioner/slip-joint module 30 includes the following sub-assemblies: at least one mandrel, or spool, 40; at least one upper flexjoint, or bearing, swivel assembly 50; at least one manifold assembly, or manifold, 60; at least one tensioning cylinder, or cylinder, 70; and at least one slip-joint assembly 90. In a specific embodiment, tensioner/slip-joint module 30 further includes at least one lower flexjoint, or bearing, swivel assembly 80. Base 85 may also be included to facilitate the communication of second tensioner/slip-joint module end 32 to additional equipment or conduits, e.g., riser string or blow-out preventer stack. Upper flexjoint swivel assembly 50, lower flexjoint swivel assembly 80, and slip-joint assembly 90 compensate for vessel offset i.e., vessel position in relationship to the well bore center and riser angle.

Mandrel 40 includes first mandrel end 41, second mandrel end 42, mandrel body 43, hang off joint 44, and at least one hang-off donut 45. Mandrel 40 maybe connected to a diverter assembly (not shown), through an interface mandrel 46 having a mandrel lower connection flange 47 which may be connected to hang-off joint 44 through any method known to persons of ordinary skill in the art. As shown in FIG. 1, mandrel lower connection flange 47 is connected to hand-off joint 44 through the use of bolts 100.

Figure 6:
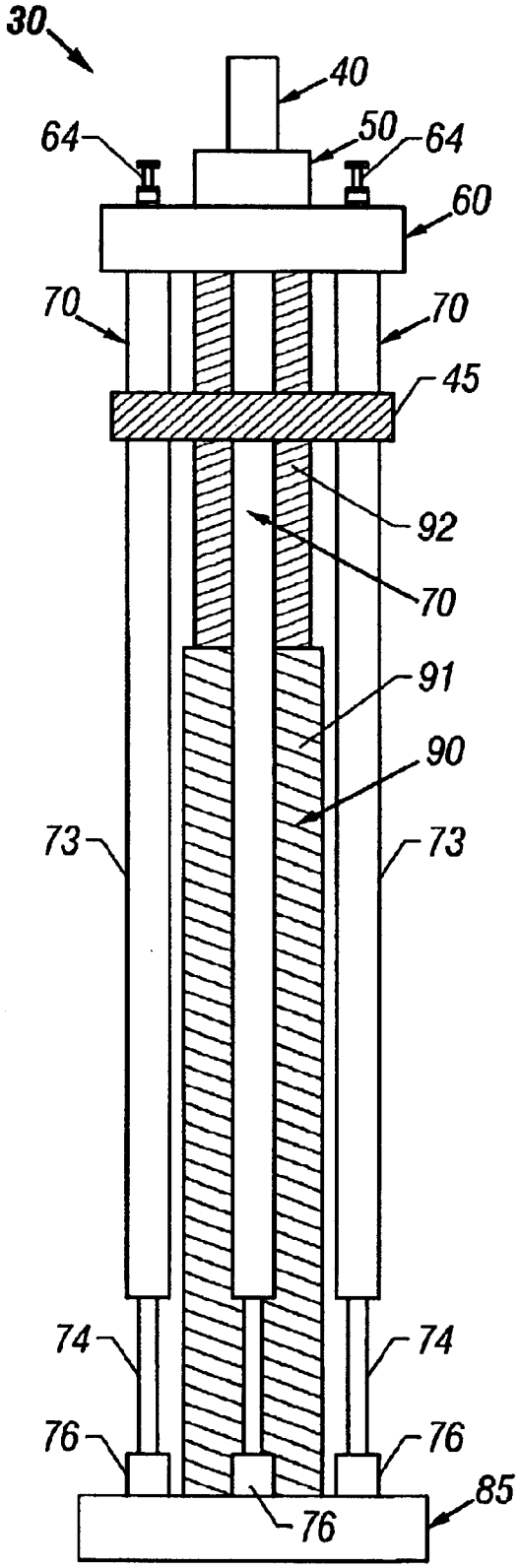
FIG. 6 is a side view of another specific embodiment of the tensioner/slip-joint module of the present invention.

Hang-off donut 45 is used to interface with a hydraulic support spider frame (not shown) which is supported under the sub-structure of the drilling platform. This allows for the complete tensioner/slip-joint module 30, including the riser and blow-out preventer (B.O.P.) stack, to be disconnected from the wellhead and "hard hung-off" and supported within the spider frame and beams when disconnected from the diverter assembly. This arrangement allows for the complete tensioner/slip-joint module 30 to be disconnected from the diverter and moved horizontally, such as via hydraulic cylinders, under the sub-structure away from the wellbore, thereby allowing access to the wellbore center and, providing clearance for the maintenance of the B.O.P. and the installation and running of well interface equipment, particularly production trees and tooling packages. Hang-off donut 45 may be integral to both the upper flexjoint swivel assembly 50 and manifold 60. Alternatively, and preferably, hang off donut 45 is disposed along the tensioning cylinders 70, thereby capturing the tensioning cylinders 70 so that hang-off donut 45 is disposed more centrally to the overall length of tensioner/slip-joint module 30 (FIG. 6). In this position, hang off donut 45 permits transference of axial tension load from cylinder casing 73 of tensioning cylinder 70 to mandrel 40 and then directly to the rig structure (not shown).

Figure 3:
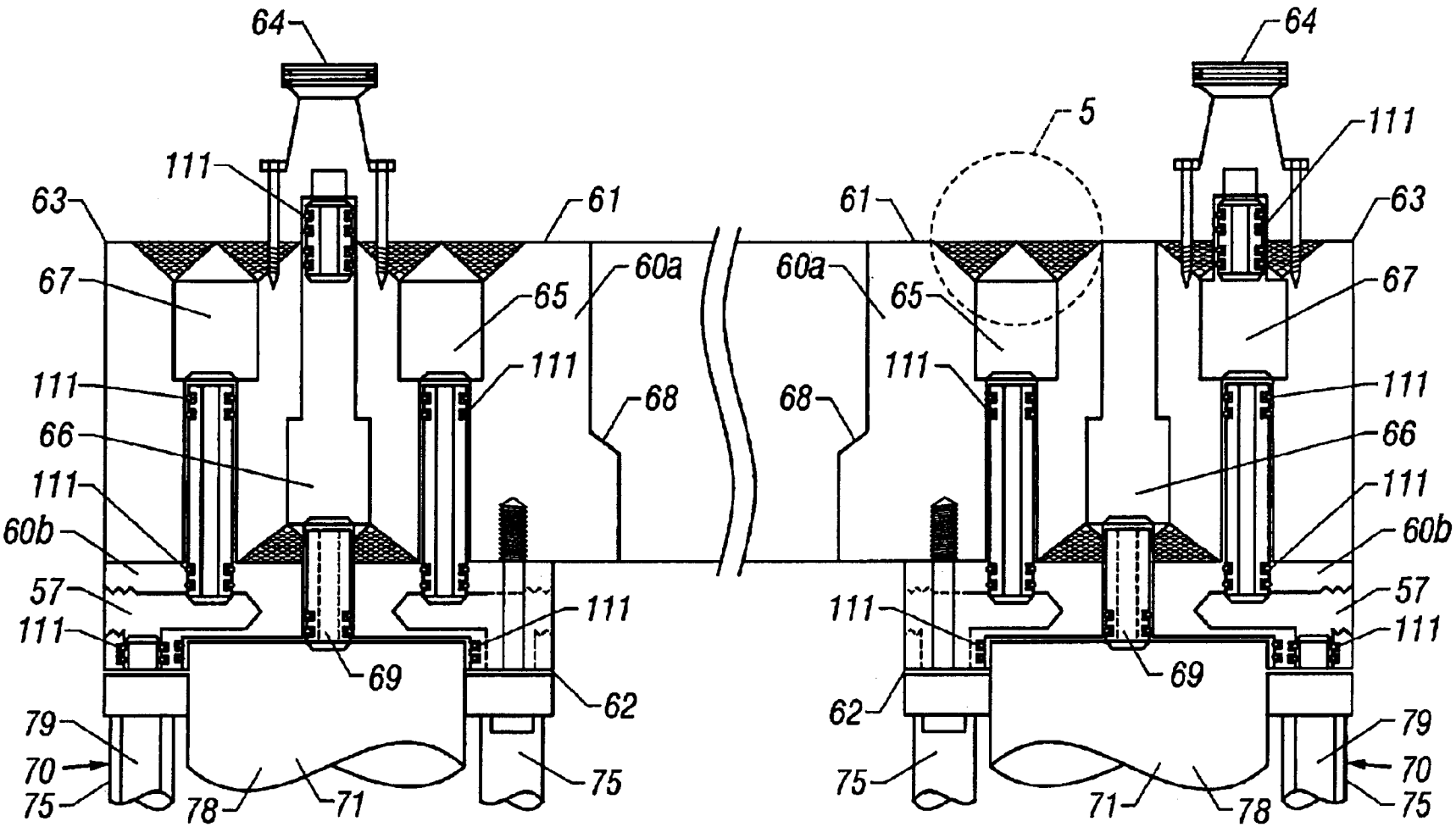
FIG. 3 is a cross-sectional view of the manifold shown in FIG. 2 taken along line 3—3.

Second mandrel end 42 is in communication with upper flexjoint swivel assembly, or upper bearing swivel assembly, 50. Upper flexjoint swivel assembly 50 includes first upper flexjoint end 51, second upper flexjoint end 52, and housing 53 having at least one swivel member, e.g., bearings, which may be disposed within housing 53 as shown in FIG. 3. Swivel members of upper flexjoint swivel assembly 50 permit rotational movement of manifold 60, tensioning cylinders 70, and lower swivel assembly 80 in the direction of arrows 58, 59 and arrows 10, 12. This arrangement allows for mandrel 40 to be locked into a connector (not shown) supported under the diverter housing (not shown) which maintains the upper flexjoint swivel assembly 50, the slip-joint assembly 90, and the marine riser (not shown) in a locked, static position, while allowing tensioning cylinders 70 and lower flexjoint swivel assembly 80 to rotate around the slip-joint assembly 90. Upper flexjoint swivel assembly 50 provides angular movement of at approximately 15 degrees over 360 degrees compensating for riser angle and vessel offset. Upper flexjoint swivel assembly 50 maybe any shape or size desired or necessary to permit movement of manifold assembly 60, tensioning cylinder 70, lower flex-joint swivel assembly 80, and slip-joint assembly 90 to a maximum of 15 degrees angular movement in any direction over 360 degrees. As shown in FIG. 1, upper flexjoint swivel assembly 50 is cylindrically shaped.

Second upper flexjoint end 52 is in communication with inner barrel 92 of slip-joint assembly 90 (discussed in greater detail below) through any method or device known to persons of ordinary skill in the art, e.g., mechanical connector, or bolts 100 (FIG. 1). Preferably, upper flexjoint swivel assembly 50 is integral with tensioner/slip-joint module 30. Upper flexjoint swivel assembly 50 permits manifold 60, and thus, the mounted tensioning cylinders 70, to move in the direction of arrows 58, 59 when in tension thereby minimizing the potential to induce axial torque and imposing bending forces on the mounted tensioning cylinders 70 and slip-joint assembly 90.

While manifold 60 may be fabricated from a solid piece of material, e.g., stainless steel, preferably manifold 60 is fabricated from two separate pieces, or sections, of material, upper manifold section 60*a*, and lower manifold section 60*b*. Manifold 60 may also be a welded fabrication of plate or fabricated from one or more castings.

Figure 2:
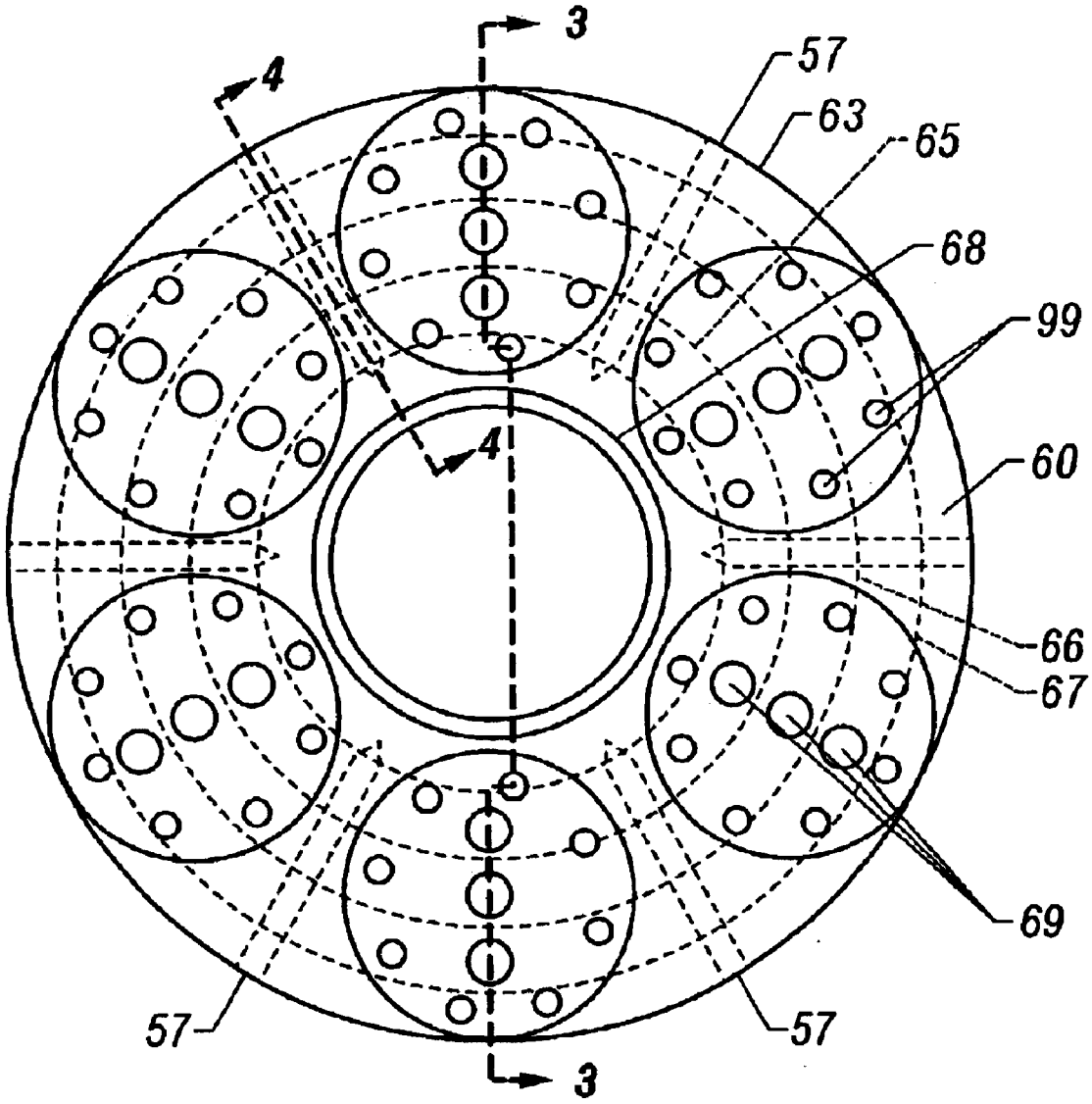
FIG. 2 is a cross-sectional view of the manifold of the tensioner/slip-joint module shown in FIG. 1 taken along line 2—2.

As illustrated in detail in FIGS. 2–3, manifold 60 includes top surface 61, bottom surface 62, manifold body 63, and bearing landing flange 68. Top surface 61 of manifold 60 preferably includes at least one control interface 64 (FIG. 1). Control interface 64 is preferably in communication with at least one tensioner cylinder 70 and at least one control source (not shown), e.g., through the use of gooseneck hose assemblies known to persons of ordinary skill in the art. Examples of suitable control sources include, but are not limited to, atmospheric pressure, accumulators, air pressure vessels (A.P.V.), and hoses for connecting the gooseneck hose assembly to the accumulator and air pressure vessel. As shown in FIGS. 1–2, tensioner/slip-joint module 30 includes two control interfaces 64 and six tensioning cylinders 70.

Control interface 64 permits pressure, e.g., pneumatic and/or hydraulic pressure, to be exerted from the control source, through control interface 64, through sub seal 69, into manifold 60, into and through radial fluid band, e.g., 65, 66, 67, and into tensioning cylinder 70 to provide tension to tensioner/slip-joint module 30 as discussed in greater detail below. It is to be understood that only one control interface 64 is required, although more than one control source 64 may be employed. Further, it is to be understood that one control interface 64 may be utilized to facilitate communication between all radial bands, e.g., 65, 66, 67, and the control source.

In one specific embodiment, control interface 64 is not required to be in communication with radial fluid band 66. In this embodiment, radial fluid band 66 may be opened to the atmosphere or may be blocked by cover 15 (FIG. 1).

Manifold 60 includes at least two, and preferably three, radial fluid bands, 65, 66, 67, which interface with blind end 71 and transfer tubing 75 of at least one tensioning cylinder 70 via seal subs 69 that intersect fluid bands 65, 66, 67 thereby providing isolated common conduits to transfer tubing 75 and blind end 71 of each tensioning cylinder 70 (FIG. 3). As further shown in FIG. 3, radial fluid bands 65, 66, 67 preferably include two upper radial bands 65, 67 and one lower radial band 66. Alternatively, radial fluid bands 65, 66, 67 of manifold 60 maybe arranged with two radial fluid bands, e.g., 65, 67, machined below the other radial fluid band, e.g., 66. In still another embodiment, radial fluid bands 65, 66, 67 may be machined co-planar to each other.

It is to be understood that one or more radial fluid bands, e.g., 65, 66, 67, may be in communication with either blind end 71 or transfer tubing 75; provided that at least one radial fluid band is in communication with each of blind end 71 and transfer tubing 75. For example, as shown in FIG. 3, two radial fluid bands 65, 67 are in communication with transfer tubing 75 and one radial fluid band 66 is in communication with blind end 71.

While each of radial fluid band 65, 66, 67 is preferably in communication with control interface 64, as shown in FIG. 3, the at least one radial fluid band in communication with the blind end 71 (radial fluid band 66 as shown in FIG. 3), may be filled with inert gas at a slight pressure above atmospheric pressure or it may be opened to the atmosphere to provide the required pressure differential into cylinder cavity 78.

Figure 4:
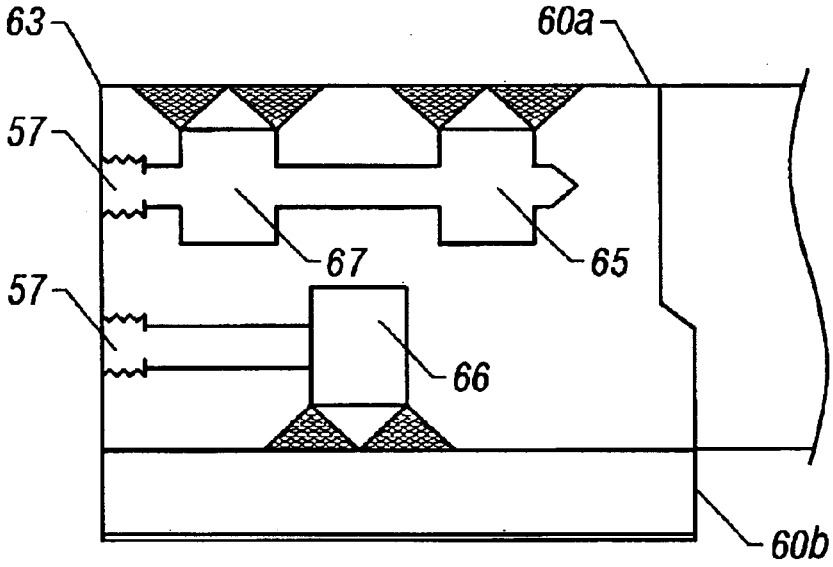
FIG. 4 is a cross-sectional view of the manifold shown in FIG. 2 taken along line 4—4.
Figure 5:
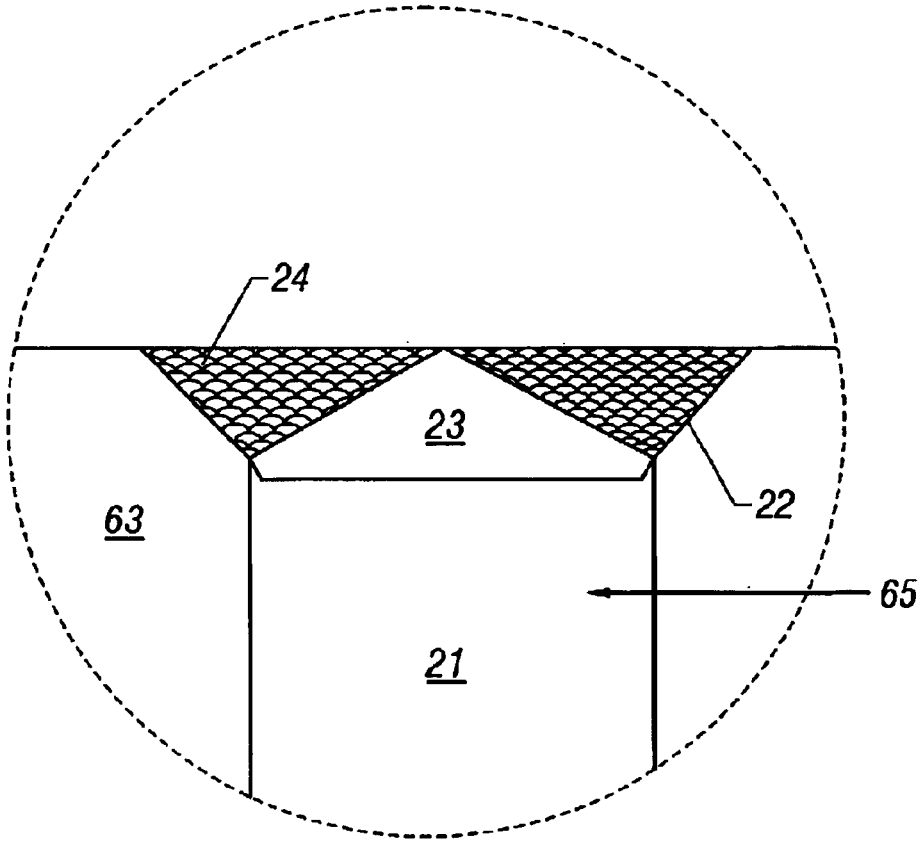
FIG. 5 is cross-sectional view of one of the radial fluid bands shown in FIG. 3.

Referring now to FIG. 4, the creation of radial fluid bands 65, 66, 67 may be accomplished by machining channels 21 in manifold body 63 to the dimensions desired or established for appropriate port volume. Machined channels 21 are profiled with weld preparation 22 which matches preparation of filler ring 23 which is welded 24 into machined channel 21 in manifold body 63. Manifold 60 is then face machined, seal sub counterbores are machined, and tensioning cylinder mounting bolt holes 99 (FIG. 2) drilled. Cross drilled transfer ports 57 are also drilled. This arrangement provides a neat, clean, low maintenance tensioning cylinder interface alleviating the need for multiple hoses and manifolding, i.e., each tensioning cylinder 70 does not require a separate control interface 64.

Top surface 61 of manifold 60 is machined to accept upper flexjoint swivel assembly 50. Manifold ports 57 facilitate the communication of the radial fluid bands 65, 66, 67 with control instrumentation, e.g., a transducer.

While manifold 60 may be fabricated or machined in any shape, out of any material, and through any method known to persons of ordinary skill in the art, preferably manifold 60 is fabricated and machined in a radial configuration as discussed above, out of stainless steel.

Each tensioning cylinder 70, discussed in greater detail below, is positioned on a radial center which aligns the porting, i.e., transfer tubing 75 and blind end 71, to the appropriate radial fluid band 65, 66, 67. Seal subs 69 having resilient gaskets 111, e.g., O-rings which are preferably redundant as shown in FIG. 3, are utilized to ensure long term reliability of the connection between control interface 64 and manifold 60 and between radial fluid bands, 65, 66, 67 and transfer tubing 75 and blind end 71.

Each tensioner cylinder 70 preferably includes blind end 71, rod end 72, cylinder casing 73, rod 74, transfer tubing 75 having transfer tubing cavity 79, cylinder head 77, and cylinder cavity 78. While cylinder casing 73 may be formed out of any material known to persons of ordinary skill in the art, cylinder casing 73 is preferably formed out of carbon steel, stainless steel, titanium, or aluminum. Further, cylinder casing 73 may include a liner (not shown) inside cylinder casing 73 that contacts rod 74.

Transfer tubing 75 may also be formed out of any material known to persons of ordinary skill in the art. In one specific embodiment, transfer tubing 75 is formed out of stainless steel with filament wound composite overlay.

In the specific embodiment shown in FIG. 1, each cylinder rod end 72 includes at least one flexjoint bearing 76. Each flexjoint bearing 76 permits rotational movement of each tensioning cylinder 70 in the direction of arrows 58, 59 and arrows 10, 12 in the same manner as discussed above with respect to upper flexjoint swivel assembly 50. As shown in FIG. 1, each flexjoint bearing 76 is in communication with base 85, and each blind end 71 is in communication with bottom surface 62 of manifold 60. Alternatively, each flexjoint bearing 76 may be in communication with lower flexjoint swivel assembly 80. Flexjoint bearing 76 preferably has a range of angular motion of +/−15 degrees for alleviating the potential to induce torque and/or bending forces on cylinder rod 74.

As shown in FIGS. 1–3, blind ends 71 are drilled with a bolt pattern to allow bolting in a compact arrangement on bottom surface 62 of manifold 60. Preferably, a plurality of appropriately sized tensioning cylinders 70 equally spaced around manifold 60 are employed to produce the tension required for the specific application. Tensioning cylinders 70 are preferably disposed with rod end 72 down, i.e., rod end 72 is closer to base 85, or lower flexjoint swivel member 80, than to manifold 60. It is to be understood, however, that one, or all, tensioning cylinders 70 may be disposed with rod end 72 in communication with manifold. In other words, not all tensioning cylinders 70 must be in communication with the at least one radial band 65, 66, 67.

Each tensioning cylinder 70 is designed to interface with at least one control source, e.g., air pressure vessels and accumulators via transfer piping 75 and manifold 60 and via blind end 71 and manifold 60.

While it is to be understood that tensioning cylinder 70 may be formed out of any material known to persons of ordinary skill in the art, preferably, tensioning cylinder 70 is manufactured from a light weight material that helps to reduce the overall weight of the tensioner/slip-joint module 30, helps to eliminate friction and metal contact within the tensioning cylinder 70, and helps reduce the potential for electrolysis and galvanic action causing corrosion. Examples include, but are not limited to, carbon steel, stainless steel, aluminum and titanium.

In the specific embodiment shown in FIG. 1, slip-joint assembly 90 includes an outer barrel 91 and an inner barrel 92. Outer barrel 91 includes inner barrel housing 93 containing elastomer packer elements (not shown) that may be energized with air or hydraulics forming a dynamic seal between outer barrel 91 and inner barrel 92 thereby alleviating the potential for fluid or mud loss from inner barrel 92 through the interface between inner barrel 92 and outer barrel 91 and into the atmosphere or ocean. Inner barrel 92 is slidably engaged with outer barrel 91 such that inner barrel 92 is permitted to move in the direction of arrows 94, 95 within outer barrel 91. Preferably, outer barrel 91 includes outer barrel lower flange 96 discussed in greater detail below, and outer barrel upper flange 97. Outer barrel upper flange 97 facilitates the creation of a seal with inner barrel 92 such that inner barrel 92 is substantially prevented from being completely removed from its slidable engagement with outer barrel 91.

In addition, a separate locking housing assembly is included in slip-joint assembly 90 allowing outer barrel 91 to be retracted by means of tensioning cylinders 70 and locked in a collapsed position with respect to inner barrel 92. This arrangement is advantageous when retracting or collapsing slip-joint assembly 90, and thus, tensioner/slip-joint module 30 to its locked position for hard riser hang-off or tensioner/slip-joint module 30 maintenance.

Lower flexjoint swivel assembly 80 is preferably in communication with base 85. Lower flexjoint swivel assembly 80 consists of inner mandrel 83 and outer radial member, or housing, 82 which contains at least one swivel member (not shown), e.g., bearings. Inner mandrel 83 includes flange 84 which is in communication with outer barrel 91, e.g., by connecting flange 86 with outer barrel lower flange 96 through any method or device known to persons of ordinary skill in the art, e.g., bolts 100 (FIG. 1).

Swivel members of lower flexjoint swivel assembly 80 permit movement of upper flexjoint swivel assembly 50, manifold 60, tensioning cylinder 70, lower flexjoint swivel assembly 80, and slip-joint assembly 90 in the direction of arrows 58, 59 and arrows 10, 12. As with upper flexjoint swivel assembly 50, lower flexjoint swivel assembly 80 is employed to further alleviate the potential for induced axial torque while tensioner/slip-joint module 30 is in tension. Preferably, lower flexjoint swivel assembly 80 has a range of angular motion of +/−15 degrees for alleviating the potential to induce torque and/or bending forces on tensioner/slip-joint module 30.

Lower flexjoint swivel assembly 80 may be any shape or size desired or necessary to permit radial movement of upper flexjoint swivel assembly 50, manifold assembly 60, tensioning cylinder 70, and lower flexjoint swivel assembly 80 in the direction of arrows 58, 59. As shown in FIG. 1, lower flexjoint swivel assembly 80 is preferably cylindrically shaped.

Base 85 facilitates connecting second end 32 of tensioner/slip-joint module 30 to other equipment and tubluars, e.g, production trees, riser components, and casing. Preferably, base 85 is equipped with a riser flange or connector (not shown) which is common to the flange/connectors employed on the riser string to facilitate connection of tensioner/slip-joint module 30 to the riser string or other components. Base 85 also includes a plurality of flexjoint bearings 76 for connecting tensioning cylinder 70 to base. Flexjoint bearing 76 alleviate the potential for tensioning cylinder 70 and rod 74 bending movement which would cause increased wear in the packing elements (not shown) in the gland seal (not shown) disposed at the interface between rod 74 and cylinder casing 73. Each flexjoint bearing 76 provides an angular motion of range of 15 degrees over 360 degrees in the direction of arrows 58, 59 and arrows 10, 12.

In drilling applications, tensioner/slip-joint module 30 is connected to the diverter (not shown), which is supported under the drilling rig floor sub-structure through any method or manner known by persons skilled in the art. In one specific embodiment, the connection between tensioner/slip-joint module 30 and the diverter may be accomplished by means of a bolted flange, e.g., via a studded connection. In another specific embodiment, tensioner/slip-joint module 30 is connected to the diverter by inserting mandrel interface 47 into a connector (not shown) attached to the diverter. In this embodiment, interface mandrel 46 includes latch dog profile 49 that connects to the connector via matching latch dogs which may be hydraulically, pneumatically, or manually energized. In addition, a metal to metal sealing gasket profile is preferably machined in the top of mandrel 40 to effect a pressure containing seal within the connector.

The tensioner/slip-joint module of the present invention may be utilized to compensate for for offset of an oil drilling vessel connected to a riser or blowout preventer stack. For example, the tensioner/slip-joint module is placed, or disposed, in communication with an oil drilling vessel and the riser or blowout preventer stack rising through the ocean from the wellbore. Manifold 60 may then be placed in communication with at least one control source.

Additionally, the oil drilling vessel may be stabilized using the tensioner/slip-joint module of the present invention by maintaining and adjusting tension in tensioning cylinders by maintaining and adjusting the pressure through tensioning cylinders by placing tensioning cylinders in communication with manifold and at least one control-source.

It is to be understood that the invention is not limited to the exact details of construction, operation, exact materials, or embodiments shown and described, as obvious modifications and equivalents will be apparent to one skilled in the art. For example, the slip-joint inner barrel housing and the outer barrel may be inverted, thereby allowing for modifications as desired or necessary to optimize the handling, operation and strength of the tensioner/slip-joint module. Further, the rod end of the tensioning cylinder maybe in communication with the manifold. Also, the individual sub-assemblies maybe manufactured separately and assembled using bolts, welding, or any other device or method known to persons of ordinary skill in the art. Moreover, the individual assemblies may be manufactured out of any material and through any method known to persons of ordinary skill in the art. Accordingly, the invention is therefore to be limited only by the scope of the claims.

What is claimed is:

1. A tensioner/slip-joint module comprising:

at least one mandrel;

at least one upper flexjoint swivel assembly in communication with the at least one mandrel;

at least one manifold in communication with the at least one upper flexjoint swivel assembly;

at least one slip-joint assembly having an inner barrel slidably engaged within an outer barrel, the inner barrel having an inner barrel housing in communication with the at least one manifold;

at least one tensioning cylinder having a blind end, a rod end, and at least one transfer tubing, the blind end and the transfer tubing being in communication with the manifold;

a base in communication with the outer barrel; and at least one lower flexjoint swivel assembly in communication with the base and the outer barrel.

2. The tensioner/slip-joint module of claim 1, wherein the manifold includes a first radial fluid band and a second radial fluid band.

3. The tensioner/slip-joint module of claim 2, wherein the blind end is in communication with the first radial fluid band and the transfer tubing is in communication with the second radial fluid band.

4. The tensioner/slip-joint module of claim 2, wherein the manifold further includes a third radial fluid band.

5. The tensioner/slip-joint module of claim 4, wherein the blind end is communication with the first radial fluid band, the transfer tubing is in communication with the second radial fluid band, and the third radial fluid band is in communication with either the blind end or the at least one transfer tubing.

6. The tensioner/slip-joint module of claim 4, wherein the first and third radial fluid bands are in communication with the at least one transfer tubing and the second radial fluid band is in communication with the blind end.

7. The tensioner/slip-joint module of claim 4, wherein at least one of the first, second, or third radial fluid bands is in communication with at least one transducer.

8. The tensioner/slip-joint module of claim 1, wherein the tensioner/slip-joint module includes six tensioning cylinders, wherein at least one of the tensioning cylinders is in communication with a first control source and at least one of the tensioning cylinders is in communication with a second control source.

9. The tensioner/slip-joint module of claim 8, wherein the first and second control sources are in communication with the same tensioning cylinder.

10. The tensioner/slip-joint module of claim 1, further comprising at least one hang off donut.

11. The tensioner/slip-joint module of claim 1, wherein the blind end is connected to the manifold by at least one sub seal.

12. The tensioner/slip-joint module of claim 1, wherein each of the at least one tensioning cylinder includes at least one cylinder head.

13. The tensioner/slip-joint module of claim 1, wherein the tensioner/slip-joint module includes at least two tensioning cylinders.

14. A tensioner/slip-joint module comprising:

at least one mandrel having a first mandrel end and a second mandrel end;

at least one upper flexjoint swivel assembly having a first upper flexjoint swivel assembly end and a second upper flexjoint swivel assembly end;

at least one manifold having a first manifold surface and a second manifold surface;

at least one slip-joint assembly having a first slip-joint assembly end and a second slip-joint assembly end;

at least one tensioning cylinder having a blind end and a rod end;

a base; and at least one lower flexjoint swivel assembly having a first lower flexjoint swivel assembly end and a second lower flexjoint swivel assembly end;

wherein the second mandrel end is connected to the first upper flexjoint swivel assembly end, the second upper flexjoint swivel assembly end is connected to the first manifold surface, the second manifold surface is connected to the first slip-joint assembly end and the blind end, the second slip-joint assembly end is connected to the first lower flexjoint swivel assembly end, and the second lower flexjoint swivel assembly end and the rod end are connected to the base.

15. The tensioner/slip-joint module of claim 14, wherein the at least one tensioning cylinder includes at least one transfer tubing, the at least one transfer tubing being in communication with the manifold.

16. The tensioner/slip-joint module of claim 15, wherein, wherein the manifold includes two radial fluid bands in communication with the at least one transfer tubing and one radial fluid band in communication with the blind end of the at least one tensioning cylinder.

17. The tensioner/slip-joint module of claim 14, wherein the tensioner/slip-joint module includes six tensioning cylinders, wherein at least one of the tensioning cylinders is in communication with a first control source and at least one tensioning cylinder is in communication with a second control source.

18. The tensioner/slip-joint module of claim 17, wherein the first and second control sources are in communication with the same tensioning cylinder.

19. The tensioner/slip-joint module of claim 14, further comprising at least one hang off donut.

20. The tensioner/slip-joint module of claim 14, wherein the slip-joint assembly includes an inner barrel slidably engaged within an outer barrel.

21. The tensioner/slip-joint module of claim 14, wherein the at least one manifold includes at least two radial fluid bands.

22. A tensioner/slip-joint module comprising:

at least one mandrel, at least one upper flexjoint swivel assembly, at least one manifold, at least one slip-joint assembly, at least one tensioning cylinder, and at least one lower flexjoint swivel assembly, wherein the at least one mandrel, the at least one upper flexjoint swivel assembly, the at least one manifold, the at least one slip-joint assembly, the at least one tensioning cylinder, and the at least one lower flexjoint swivel assembly are assembled to form a unitary, co-linear tensioner/slip-joint module.

23. The tensioner/slip-joint module of claim 22, wherein the at least one mandrel is connected to the at least one upper flexjoint swivel assembly, the at least one upper flexjoint swivel assembly is connected to the at least one manifold, the at least one manifold is connected to the at least one slip-joint assembly and the at least one tensioning cylinder, and the at least one slip-joint assembly and the at least one tensioning cylinder are connected to the at least one lower flexjoint swivel assembly.

24. A method of compensating for offset of an oil drilling vessel connected to a riser or blowout preventer stack comprising the steps of:

providing a tensioner/slip-joint module, the tensioner/slip-joint module having at least one mandrel, at least one upper flexjoint swivel assembly, at least one manifold, at least one slip-joint assembly, at least one tensioning cylinder, and at least one lower flexjoint swivel assembly, wherein the at least one mandrel, the at least one upper flexjoint swivel assembly, the at least one manifold, the at least one slip-joint assembly, the at least one tensioning cylinder, and the at least one lower flexjoint swivel assembly are assembled to form a unitary, co-linear tensioner/slip-joint module;

placing the tensioner/slip-joint module in communication with the oil drilling vessel and the riser or blowout preventer stack; and placing the manifold in communication with at least one control source.

* * * * *